US008956167B2

(12) United States Patent
Wu et al.

(10) Patent No.: US 8,956,167 B2
(45) Date of Patent: Feb. 17, 2015

(54) CABLE END CONNECTOR WITH CONNECTING BAR

(71) Applicants: Jerry Wu, Irvine, CA (US); Jun Chen, Kunshan (CN); Feng-Jun Qi, Kunshan (CN)

(72) Inventors: Jerry Wu, Irvine, CA (US); Jun Chen, Kunshan (CN); Feng-Jun Qi, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 83 days.

(21) Appl. No.: 13/684,064

(22) Filed: Nov. 21, 2012

(65) Prior Publication Data

US 2013/0130546 A1 May 23, 2013

(30) Foreign Application Priority Data

Nov. 23, 2011 (CN) ..... 2011 1 0375650

(51) Int. Cl.

| | |
|---|---|
| ***H01R 4/66*** | (2006.01) |
| ***H01R 13/40*** | (2006.01) |
| ***H01R 13/6471*** | (2011.01) |
| *H01R 107/00* | (2006.01) |

(52) U.S. Cl.

CPC ..... *H01R 13/40* (2013.01); *H01R 13/6471* (2013.01); *H01R 2107/00* (2013.01)

USPC ..... 439/98; 439/497

(58) Field of Classification Search

CPC ..... H01R 4/646; H01R 12/79; H01R 13/658; H01R 13/65802; H01R 23/662; H01R 23/7073

USPC ..... 439/95–98, 108, 493, 497, 579, 439/607.41–607.5, 660

See application file for complete search history.

(56) References Cited

U.S. PATENT DOCUMENTS

| | | | | |
|---|---|---|---|---|
| 6,585,536 | B1 * | 7/2003 | Wu | 439/358 |
| 6,875,048 | B2 * | 4/2005 | Lee | 439/497 |
| 7,052,292 | B2 * | 5/2006 | Hsu et al. | 439/98 |
| 7,214,097 | B1 * | 5/2007 | Hsu et al. | 439/607.47 |
| 7,435,132 | B1 * | 10/2008 | Fong et al. | 439/497 |
| 7,497,724 | B1 * | 3/2009 | Fong et al. | 439/497 |
| 7,632,155 | B1 * | 12/2009 | Wu | 439/660 |
| 7,651,379 | B1 * | 1/2010 | Wu | 439/660 |
| 8,337,243 | B2 * | 12/2012 | Elkhatib et al. | 439/581 |

OTHER PUBLICATIONS

HDMI D Type defined High-Definition Multimedia Interface Specification Version 1.4, p. 15, 35,36.

* cited by examiner

*Primary Examiner* — Thanh Tam Le

(74) *Attorney, Agent, or Firm* — Wei Te Chung; Ming Chieh Chang

(57) ABSTRACT

A cable end connector includes an insulating housing defining a rear cable-location portion thereof, a plurality of conductive terminals including contacting portions and terminal portions located in the rear cable-location portion, a plurality of cables each having wires and a connecting bar defining a first touching end and a second touching end. The wires of the cable overlap the terminal portions one by one except one wire and one terminal portion. The first touching end overlaps one terminal portion and the second touch end overlaps said one wire so as to establish an electrical connection through the connecting bar between said one terminal portion and one wire.

7 Claims, 3 Drawing Sheets

CABLE END CONNECTOR WITH CONNECTING BAR

BACKGROUND OF THE INVENTION

1. Field of the invention

The present invention relates to a cable end connector which has a connecting bar.

2. Description of Related Art

A conventional cable end connector includes a connector body and cables. The connector body includes a plurality of conductive terminals connecting with corresponding wires of the cables. Since the signal terminals discrete from grounding terminals with larger spaces, at least one wire of the cable need step across several terminals to connect with corresponding terminal, resulting in a difficult to arrange the wires and a bad shielding of cross-talk of the grounding terminals.

An improved cable end connector is desired.

SUMMARY OF THE INVENTION

An object of the present invention is to provide a cable end connector with connecting bar.

In order to achieve above-mentioned object, a cable end connector comprises an insulating housing defining a rear cable-location portion thereof, a plurality of conductive terminals comprising contacting portions and terminal portions located in the rear cable-location portion, a plurality of cables each having wires and a connecting bar defining a first touching end and a second touching end. The wires of the cable overlap the terminal portions one by one except one wire and one terminal portion. The first touching end overlap one terminal portion and the second touch end overlaps said one wire so as to establish an electrical connection through the connecting bar between said one terminal portion and one wire.

Other objects, advantages and novel features of the present invention will become more apparent from the following detailed description of the present embodiment when taken in conjunction with the accompanying drawings.

DETAILED DESCRIPTION OF THE INVENTION

Figure 1:
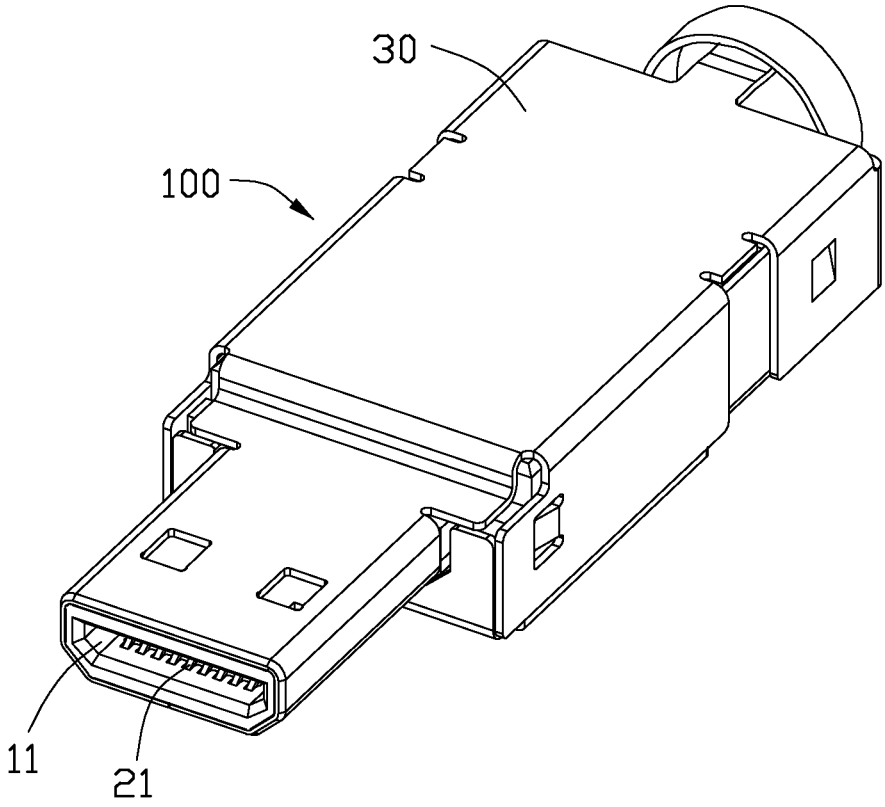
FIG. 1 is a perspective front view of a cable end connector in accordance with the present invention.

Reference will now be made to the drawing figures to describe the preferred embodiment of the present invention in detail.

Figure 2:
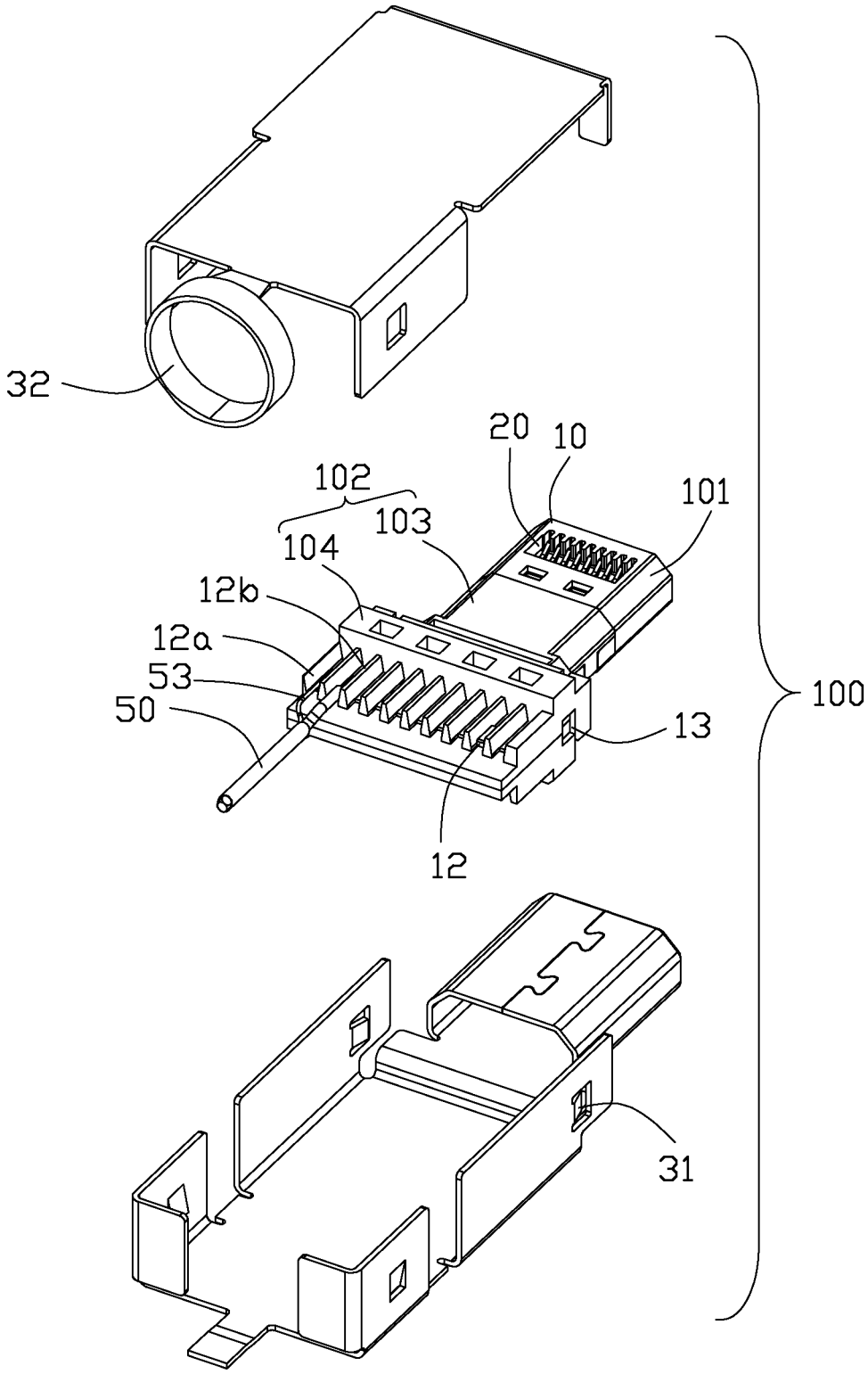
FIG. 2 is an exploded perspective view of the cable end connector.

Referring to FIGS. 1 and 2, a cable end connector 100 compatible to HDMI D Type defined High-Definition Multimedia Interface Specification Version 1.4, which transferring differential signal. The connector includes an insulating housing 10, a plurality of conductive terminals 20 and a shell 30 shielding the connector.

The insulating housing includes a from end 101 and a rear end 102 retained with each other by a locking mechanism. The front end 102 defines a mating cavity 11 through a front face thereof The unitary rear end 102 includes a middle portion 103 which has a same dimension with and locks with the front portion 101, and a rear portion 104 or retained portion with a larger dimension than the middle portion 103. The rear portion 104 defines a plurality of grooves 12 petitioned by rib walls and opening upwards, which is provided for connecting cables, i.e. a cable-location portion.

Figure 3:
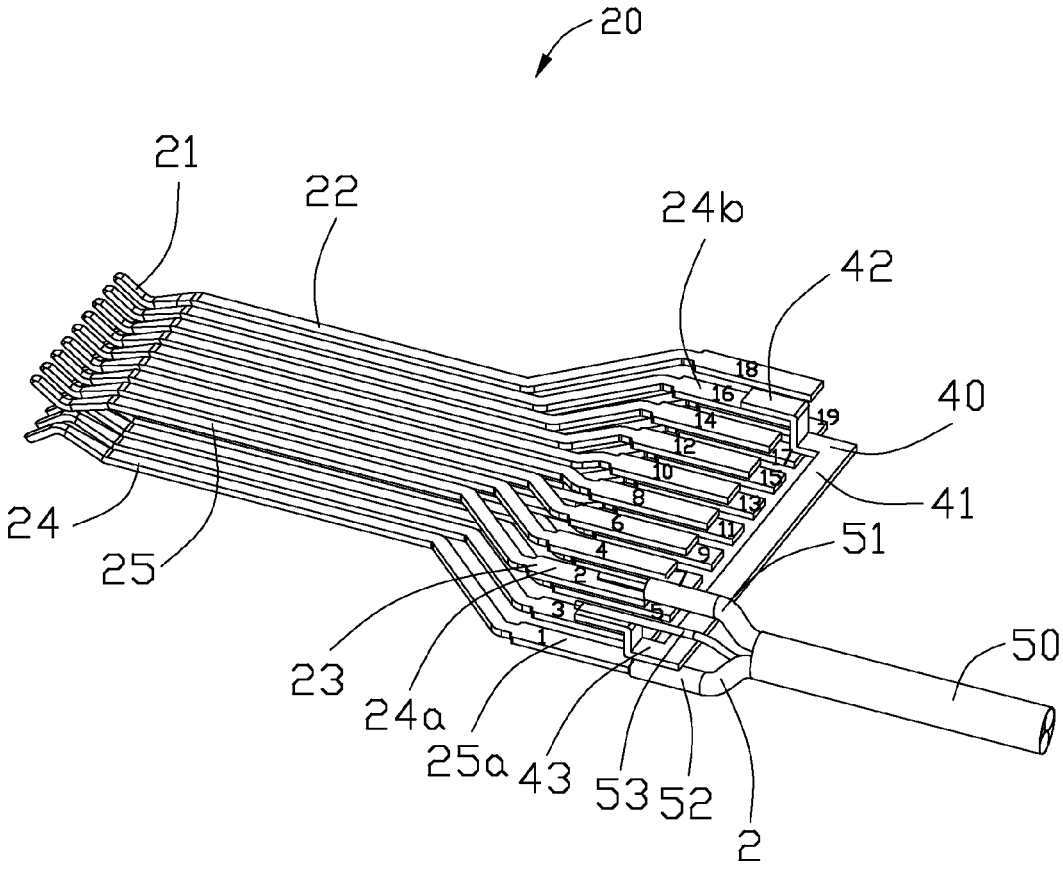
FIG. 3 is a perspective view of terminals and a cable connected with each other.

Combination with FIG. 3, the terminals 20 arranged in two-row pattern are formed by inserted mold with the insulating housing 10. Each terminal includes a contacting portion 21 extending in the mating cavity 11, a retaining portion 22 extending rearwards from the contacting portion and a terminal portion 23 extending rearwards from the retaining portion. The terminal portions 23 are received in first grooves 12*a* one by one and a second or free groove 12*a* at the left outermost of the lower row is free without any terminal portions of the terminals. The second groove 12*b* is provided for a grounding wire 53 of a cable 50, which will be described hereinafter. Other terminal portions overlap the wires of cables which do not shown in FIG. 3

A connecting bar 40 is embedded in the insulative housing 10, which includes a main portion 41 located behind the terminal portions 23, a first touching portion 42 and a second touch portion 43 forwards extending and bending from opposite ends of the main portion 41. The first touching portion 42 overlaps a terminal portion 24*b* of one terminal located at the second outermost of the lower row of terminals while the second touching portion 43 extend into the first groove 12*a* to connect with said grounding wire 53. Therefore, an electrical connection between said grounding wire and said one terminal portion 24*b* are established by said connecting bar. The first touching portion is permanently connecting with the terminal portion 24*b* by soldering or other method. The connecting bar 4 is alternatively formed with other conductive elements such as a copper foil, a metal wire, etc.

In HDMI Specification, a D-shaped HDMI connector includes nineteen conductive terminals P1~P19. A receptacle or board connector is loaded with these nineteen terminals in two rows in an interface thereof. Odd-number terminals P1, P3 . . . P19 are located at the upper row and even -number terminals P2, P4 . . . P18 are located at the lower row. A cable end plug or connector mating with the receptacle also has nineteen terminals in such array and a plurality of cables 50 connects with the terminals of the mating plug. The P3, P5 terminals (in FIG. 3, numerals 1-19 are labeled to show P1-P29 terminals) on the upper lower of the terminals are configured as a differential pair and P4 corresponds to said differential pair on the lower row is configured as a grounding signal, said three terminals are disposed in an inverted triangle pattern. The P6, P8, P7 are also configured in a triangle pattern. The P9, P11, P10 are configured in an inverted triangle pattern. The P12, P14, P13 are also configured in an inverted triangle pattern. That is, the nineteen terminals include four first groups (P3-5, P6-8, P9-11, P12-14) each comprising a pair of differential signal terminals and a grounding signal terminal. Please notes the P1, P2 are discrete signal terminal and P16 is a discrete grounding terminal, that is to say which three terminals do not configured as a triangle differential signal pattern. The two discrete signal terminals P1, P2 and one discrete grounding terminal P16 are disposed at opposite sides of said four first groups. In this embodiment of a HDMI D type cable end connector, the terminals 25*a*, 24*a* is functioned as P1, P2 and the terminal 24*b* is functioned as P16. Generally, at least five cables 50 connect with the terminals, each cable includes two signal wires 51, 52 and a grounding wire 53. In FIG. 3, only one cable is shown, the other cables are same to the shown cable 50 and omitted. The signal wires of the cables connect with said four differential pair signal terminals and the grounding wires of the cables connects with corresponding grounding signal terminals, respectively (not shown in FIG. 3). When the signal wires 51, 52, of one cable (shown in FIG. 3) connects with P1, P2, the grounding wire 53 of this one cable should connect with the terminals 24*b* since there is no corresponding grounding terminal and it is clearly shown that the grounding wire 53 will extend a larger distance to connect with the grounding terminal 24*b* if without the connecting bar 40. The connecting bar 40 electrically extends the terminal 24*b* to a position adjacent to terminals 24*a*, 24*b*, so that the grounding wire 53 will not detour. Moreover, the grounding wire 53 is located near to the signal wires 51, 52 to ensure a good anti-cross-talk.

The shielding shell 30 is construed with two portions surrounding the housing and locking with each other. The spring arm 31*s* are retained in the cutouts 13 defined in the rear portion 104. The front portion of the shell surrounds the front ends 101 to shielding the contacting portions of the terminals in the mating cavity and the rear portion of the shell surrounds the wires and the connecting portions of the terminals. A ring is formed in the shell to be provided for the cables 50.

However, the disclosure is illustrative only, changes may be made in detail, especially in matter of shape, size, and arrangement of parts within the principles of the invention.

What is claimed is:

1. A HDMI D Type cable end connector comprising:

an insulating housing defining a front mating cavity and a rear cable-location portion;

a plurality of conductive terminals held in the insulating housing, the plurality of terminals comprising contacting portions disposed in the front mating cavity and terminal portions disposed in the rear cable-location portion;

the plurality of terminals including four first groups each comprising a pair of differential signal terminals and a grounding signal terminal in a triangle pattern, and two discrete signal terminals and one discrete grounding terminal at opposite sides of said four first groups;

a plurality of cables comprising five cables each including two signal wire and a grounding wire, four of said five cables connecting with said four first groups respectively, the two signal wires of the remaining one of said five cables connect with the terminal portions of said two discrete signal terminals respectively; and a connecting bar defining a first touching end and a second touching end, the first touching end connecting with the terminal portions of said discrete grounding terminals, the second touching end connecting with the grounding wire of said the remaining one of the five cables;

wherein the terminal portions of the terminals are arranged in two rows, the differential signal terminals of each of said four first groups are located at one row and the grounding signal of each of said four first groups is located the other row;

wherein said two discrete signal terminals are located at said two rows respectively;

wherein the rear cable-location portion defines a plurality of grooves, said terminal portions of the terminals are disposed in the grooves one by one remained with a free groove, said second touching end and the grounding wire of said the remaining one of the five cables are located in the free groove; and wherein said connecting bar is discrete from said plurality of terminals.

2. The HDMI D Type cable end connector as described in claim 1, wherein the connecting bar is embedded in the insulating housing behind the cable-location portion.

3. A cable end connector comprising:

an insulating housing defining a rear cable-location portion thereof;

a plurality of conductive terminals comprising contacting portions and terminal portions located in the rear cable-location portion;

a plurality of cables each having wires, the wires of the cable touching the terminal portions one by one except one wire and one terminal portion;

a connecting bar defining a first touching end and a second touching end, the first touching end touching one terminal portion and the second touching end touching said one wire so as to establish an electrical connection through the connecting bar between said one terminal portion and one wire;

wherein the insulating housing defines a plurality of first grooves and a second groove at the rear cable-location portion thereof, said terminal portions are located in the first grooves, said second touching end and one wire are located in the second groove; and wherein the connecting bar is embedded in the insulating housing behind the rear cable-location portion and is discrete from said plurality of conductive terminals.

4. A cable connector assembly comprising:

an insulative housing defining a front mating port and a rear connecting port in a front-to-back direction;

a plurality of contacts categorized with differential pairs and grounding contacts and dispose in the housing and spanning in a transverse direction perpendicular to said front-to-back direction, each of said contacts defining along said front-to-back direction, a front mating section having a small pitch thereof, and rear connection section having a large pitch thereof, at least one cable located behind the housing and enclosing a pair of signal wires electrically connected to the rear connecting sections of the corresponding differential pair located around one first transverse end of said housing in said transverse direction, and a grounding wire electrically connected to the rear connecting section of the corresponding grounding contact around a second transverse end opposite to said first transverse end in said transverse direction; and a grounding bar located around the rear connecting sections of the contacts and including a first contacting region, around said second transverse end, directly mechanically and electrically connecting to the connecting section of the corresponding grounding contact and a second contacting region, around said first transverse end, to which the grounding wire is mechanically and electrically connected; wherein the first contacting region and the second contacting region are essentially aligned with the rear connecting sections of the contacts in said transverse direction;

the housing defines a plurality of grooves to receive the corresponding connecting sections, and each of said first contacting region and said second contacting region is further received in the corresponding groove;

in said grooves, a first groove receives only the second contacting region of the grounding bar and the corresponding grounding wire with no contacting section of the contact, a second groove receives only the first contacting region of the grounding bar and the connecting section of the corresponding grounding contact with no wire, and a third groove receives the contacting section of the differential pair and the corresponding signal wire with no portion of the grounding bar; and said grounding bar is discrete from said plurality of contacts.

5. The cable connector assembly as claimed in claim 4, wherein said contacts are arranged in two rows each extending in said transverse direction, and the differential pair are respective located in said two rows respectively, and the grounding bar defines a main portion, which links said two contacting regions, located between said two rows.

6. The cable connector assembly as claimed in claim 5, wherein the first contacting region is located upon the connecting section of the corresponding grounding contact while the second contacting region is located at a same level with the connecting section of the corresponding contact.

7. The cable connector assembly as claimed in claim 4, wherein all said contacts are of a same length along a front-to-back direction.

* * * * *